US011711873B1

(12) United States Patent
Montemurro et al.

(10) Patent No.: US 11,711,873 B1
(45) Date of Patent: Jul. 25, 2023

(54) DRIVER CIRCUITS FOR CONTROLLING PHASE SHIFT CHANGES IN LIGHT EMITTING DIODES

(71) Applicant: Infineon Technologies AG, Neubiberg (DE)

(72) Inventors: Floriano Montemurro, Albignasego (IT); Alfonso Nasciuti, Parma (IT); Andrea Scenini, Montegrotto Terme (IT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 17/654,372

(22) Filed: Mar. 10, 2022

(51) Int. Cl.
*H05B 45/30* (2020.01)
*H05B 45/31* (2020.01)
*H05B 45/325* (2020.01)

(52) U.S. Cl.
CPC ..... *H05B 45/325* (2020.01); *H05B 45/31* (2020.01)

(58) Field of Classification Search
CPC ..... H05B 45/30; H05B 45/31; H05B 45/32; H05B 45/325; H05B 45/40; G09G 3/32; G09G 3/325; G09G 3/2014; G09G 3/34; G09G 3/342
See application file for complete search history.

(56) References Cited

U.S. PATENT DOCUMENTS 7,847,491 B2 * 12/2010 Lin ..... H02J 1/14 315/307
11,343,888 B1 * 5/2022 Lopez Julia ..... H05B 45/14
2011/0121761 A1 * 5/2011 Zhao ..... H05B 45/37 315/312
2013/0193859 A1 * 8/2013 Yang ..... H05B 45/325 327/239

FOREIGN PATENT DOCUMENTS

WO 2012122315 A1 9/2012
WO 2013173776 A1 11/2013

* cited by examiner

*Primary Examiner* — Thai Pham
(74) *Attorney, Agent, or Firm* — Shumaker & Sieffert, P.A.

(57) ABSTRACT

Driver circuits are described for driving one or more light emitting diodes. A driver circuit may comprise an interface configured to receive control signals from a processor and a signal generator configured to generate pulse modulation (PM) signals based on the control signals, wherein the PM signals define phase shifts. In some examples, the signal generator is configured to: determine whether the control signals indicate a phase shift change; and in response to determining that the control signals indicate a phase shift change, terminate a current PM signal at a beginning of a PM period, and generate a new PM signal in the PM period, wherein the new PM signal includes the phase shift change. In other examples, termination may be avoided in some (Continued)

situations, for example, upon determining that a new phase shift is not sufficiently less than a previous phase shift.

18 Claims, 8 Drawing Sheets

DRIVER CIRCUITS FOR CONTROLLING PHASE SHIFT CHANGES IN LIGHT EMITTING DIODES

TECHNICAL FIELD

This disclosure relates to circuits for driving and controlling light emitting diodes (LEDs) and, more specifically, to circuits and techniques for controlling LEDs in a vehicle or similar setting.

BACKGROUND

Driver circuits are often used to control a voltage, current, or power at a load. For instance, a light emitting diode (LED) driver circuit may control the power supplied to one or more light emitting diodes. Some LED circuits include different colored LEDs, such as red (R), green (G), and blue (B), or possibly other color combinations. RGB LEDs, for example, may be controlled to adjust the colors emitted by the LEDs, e.g., by controlling the relative combination of ON time amongst red, green, and blue LEDs. RGB LEDs may also be controlled to achieve lighting effects or to adjust brightness, color temperature, or other lighting factors or conditions.

In automotive settings and other types of settings, a processor, such as a microprocessor, a graphics processing unit (GPU), an electronic control unit (ECU), or other clock-based processing circuit may provide control signals to the driver circuits in order to control the driver circuits and thereby control lighting functions and effects of one or more LEDs.

SUMMARY

This disclosure is directed to circuits and techniques for controlling light emitting diodes (LEDs). Some LED control signals may include defined phase shifts, e.g., which define a delay of a pulse modulation (PM) signal relative to a beginning of a PM period. In such situations, changes in the phase shift can be used to change the light output by the LED. Unfortunately, phase shift changes can sometimes cause undesirable glitches in PM signals, which can create undesirable lighting artifacts. The circuits and techniques of this disclosure may reduce or eliminate such glitches and may be especially desirable for multi-channel LED lighting where color changes are possible, such as with so-called red, green, and blue (RGB) LEDs or any LED lighting where PM signals can be defined by phase shifts and duty cycles.

In some examples, this disclosure describes a driver circuit for driving one or more light LEDs, wherein the driver circuit comprises an interface configured to receive control signals from a processor, and a signal generator configured to generate PM signals based on the control signals, wherein the PM signals define phase shifts. The signal generator may be configured to determine whether the control signals indicate a phase shift change; and in response to determining that the control signals indicate a phase shift change, terminate a current PM signal at a beginning of a PM period, and generate a new PM signal in the PM period, wherein the new PM signal includes the phase shift change.

In other examples, this disclosure describes a driver circuit for driving one or more LEDs, wherein the driver circuit comprises an interface configured to receive control signals from a processor, and a signal generator configured to generate PM signals based on the control signals, wherein the PM signals define phase shifts, and wherein the signal generator is configured to: determine whether the control signals indicate a phase shift change; in response to determining that the control signals indicate the phase shift change, determine whether a new phase shift is sufficiently less than a previous phase shift; in response to determining that the new phase shift is sufficiently less than the previous phase shift, terminate a current PM signal at a beginning of a PM period; and in response to determining that the control signals indicate the phase shift change, generate a new PM signal in the PM period, wherein the new PM signal includes the phase shift change.

In some examples, this disclosure describes a method of driving one or more LEDs. The method may comprise receiving control signals from a processor; generating PM signals based on the control signals, wherein the PM signals define phase shifts, determining, during a sampling period that occurs between each of a plurality of PM periods associated with the PM signals, whether the control signals indicate a phase shift change; in response to determining that the control signals indicate a phase shift change, terminating a current PM signal at a beginning of a PM period, and generating a new PM signal in the PM period, wherein the new PM signal includes the phase shift change; and in response to determining that the control signals do not indicate a phase shift change, outputting the current PM signal at the beginning of the PM period.

In other examples, a method of driving one or more LEDs may comprise receiving control signals from a processor; generating PM signals based on the control signals, wherein the PM signals define phase shifts; determining, during a sampling period that occurs between each of a plurality of PM periods associated with the PM signals, whether the control signals indicate a phase shift change; in response to determining that the control signals indicate the phase shift change, determining whether a new phase shift is sufficiently less than a previous phase shift; in response to determining that the new phase shift is sufficiently less than the previous phase shift, terminating a current PM signal at a beginning of a PM period; in response to determining that the control signals indicate the phase shift change, generating a new PM signal in the PM period, wherein the new PM signal includes the phase shift change; and in response to determining that the control signals do not indicate a phase shift change, outputting the current PM signal at the beginning of the PM period.

In some examples, this disclosure describes a system comprising a processor, one or more LEDs, and a driver circuit for driving the one or more LEDs based on control signals from the processor. The driver circuit may comprise an interface configured to receive the control signals from the processor; and a signal generator configured to generate PM signals based on the control signals, wherein the PM signals define phase shifts. The signal generator is configured to determine whether the control signals indicate a phase shift change; and in response to determining that the control signals indicate a phase shift change, terminate a current PM signal at a beginning of a PM period, and generate a new PM signal in the PM period, wherein the new PM signal includes the phase shift change.

In other examples, this disclosure describes a system comprising a processor, one or more LEDs, and a driver circuit for driving the one or more LEDs based on control signals from the processor, wherein the driver circuit comprises: an interface configured to receive the control signals from the processor; and a signal generator configured to generate PM signals based on the control signals, wherein the PM signals define phase shifts, and wherein the signal generator is configured to: determine whether the control signals indicate a phase shift change; in response to determining that the control signals indicate the phase shift change, determine whether a new phase shift is sufficiently less than a previous phase shift; in response to determining that the new phase shift is sufficiently less than the previous phase shift, terminate a current PM signal at a beginning of a PM period; and in response to determining that the control signals indicate the phase shift change, generate a new PM signal in the PM period, wherein the new PM signal includes the phase shift change.

Details of these and other examples are set forth in the accompanying drawings and the description below. Other features, objects, and advantages will be apparent from the description and drawings, and from the claims.

DETAILED DESCRIPTION

This disclosure is directed to circuits and techniques for controlling light emitting diodes (LEDs), such as in a vehicle or another setting. The circuits and techniques may be used to control interior RGB LEDs of a vehicle, but in other examples, the circuits and techniques may be used for exterior lights, interior lights, vehicle headlamps, or any type of vehicle lighting that uses LEDs. Moreover, although described for vehicle settings, the described circuits and techniques for controlling LEDs can also be used in any other setting where LEDs are used.

Some circuits use LED control signals that control the operation of LEDs based at least in part on defined phase shifts, e.g., which define a delay of a PM signal relative to a beginning of a PM period. In such situations, changes in the phase shift can be used to change the light output by the LED. Unfortunately, phase shift changes can sometimes cause undesirable glitches in PM signals, which can create undesirable lighting artifacts. The circuits and techniques of this disclosure may reduce or eliminate such glitches and may be especially desirable for multi-channel LED lighting where color changes are possible, such as with so-called red, green, and blue (RGB) LEDs or any LED lighting where PM signals can be defined by phase shifts and duty cycles.

Figure 1:
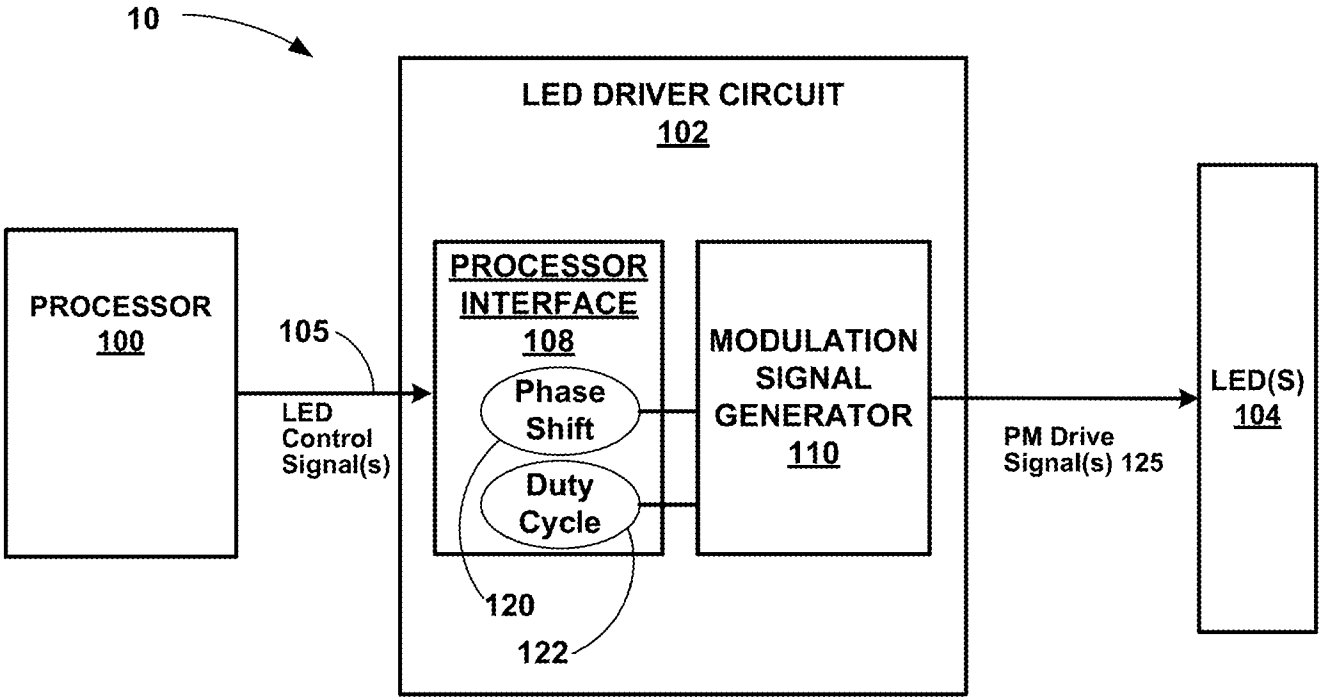
FIG. 1 is block diagram showing a system that includes a driver circuit configured to control one or more LEDs consistent with the teaching of this disclosure.

FIG. 1 is block diagram showing a system 10 that includes a driver circuit 102 configured to control one or more LEDs 104, consistent with the teaching of this disclosure. System 10 includes a processor 100, a driver circuit 102, and one or more LEDs 104. Driver circuit 102 is configured to drive the one or more LEDs 104 based on control signals 105 from processor 100. The control signals 105 from processor 100 may ultimately define PM drive signals 125 that drive LEDs 104. As described in greater detail below, driver circuit 102 may be configured to identify one or more situations where glitches could occur due to phase shift changes in LED control signals 105, and driver circuit 102 may respond in ways that can reduce or eliminate such glitches in PM drive signals 125.

LED driver circuit 102 may comprise a processor interface 108 configured to receive control signals 105 from processor 110. Moreover, LED driver circuit 102 may also comprise a modulation signal generator 110 configured to generate PM drive signals 125 based on control signals 105. The PM drive signals 125, for example, may comprise so-called pulse width modulation (PWM) signals, or other types of modulation signals, such as pulse frequency modulation signals, pulse duration modulation signals, pulse density modulation signals, or other types of modulation signals used for driving LEDs.

LED control signals 105 and PM drive signals 125 may define phase shifts. In some examples, LED control signals 105 and PM drive signals 125 may define phase shifts and duty cycles. Accordingly, processor interface 108 may be configured to determine a phase shift 102 and a duty cycle 122 defined by LED control signals 105 from processor 100, and modulation signal generator 110 may generate PM drive signals 125 that include the phase shift 120 and duty cycle 122 defined by LED control signals 105.

In some examples, modulation signal generator 110 may be configured to determine whether the control signals 105 indicate a phase shift change, and in response to determining that the control signals indicate a phase shift change, modulation signal generator 110 may be configured to terminate a current PM signal at a beginning of a PM period and generate a new PM signal in the PM period, wherein the new PM signal includes the phase shift change. As explained in greater detail below, such a technique may help eliminate situations that may otherwise cause a so-called long glitch in LED control, but the technique may still sometimes result in a so-called short glitch, which may be more acceptable than a long glitch for some LED applications.

In other examples, modulation signal generator 110 may be configured to determine whether the control signals 105 indicate a phase shift change; in response to determining that the control signals 105 indicate the phase shift change, determine whether a new phase shift is sufficiently less than a previous phase shift; in response to determining that the new phase shift is sufficiently less than the previous phase shift, terminate a current PM signal at a beginning of a PM period; and in response to determining that the control signals indicate the phase shift change, generate a new PM signal in the PM period, wherein the new PM signal includes the phase shift change. In this case, both a long glitch and a short glitch may be avoided for at least some situations.

In some cases, LED control signals 105 indicate duty cycles and phase shifts, and at least some of the PM drive signals 125 wrap across successive PM periods associated with the PM signals. So-called wrapping is discussed in greater detail below, and is useful for the control of RGB LEDs, as well as other types of LEDs. In some examples of this disclosure, the one or more LEDs 104 may comprise one or more Red, Green, or Blue LEDs or may comprise a set of Red, Green, and Blue LEDs that operate collectively to define specific colors. In this case, driver circuit 102 may controls each of the Red, Green, and Blue LEDs, and the duty cycles and the phase shifts defined by control signals 105 may control a combined color created by a combination of the Red, Green, and Blue LEDs.

In some examples, modulation signal generator 110 may define a sampling period that occurs between each of a plurality of PM periods associated with the PM signals. During this sampling period, modulation signal generator 110 may perform determinations according to this disclosure. For example, modulation signal generator 110 may be configured to determine, during a sampling period that occurs between each of a plurality of PM periods associated with the PM signals, whether control signals 105 indicate the phase shift change. The sampling period, for example, may comprise one clock cycle (or possibly several clock cycles) of a system clock associated with modulation signal generator. If the system clock operates at 40 Megahertz, for example, one clock cycle may comprise approximately 25 nanoseconds. In contrast, a PM period may last for a period of time that is on the order of a millisecond. In this case, if the sampling period is less than 100 nanoseconds, then the sampling period may comprise less than 1/10,000 of the PM period.

If there is no phase shift change, then modulation signal generator 110 may continue to drive LEDs 104 with PM drive signals 125 that do not change. In this case, for example, modulation signal generator 110 may be configured to, in response to determining that the control signals do not indicate a phase shift change, generate a new version of the current PM signal in the PM period without terminating the current PM signal at the beginning of the PM period.

Figure 2:
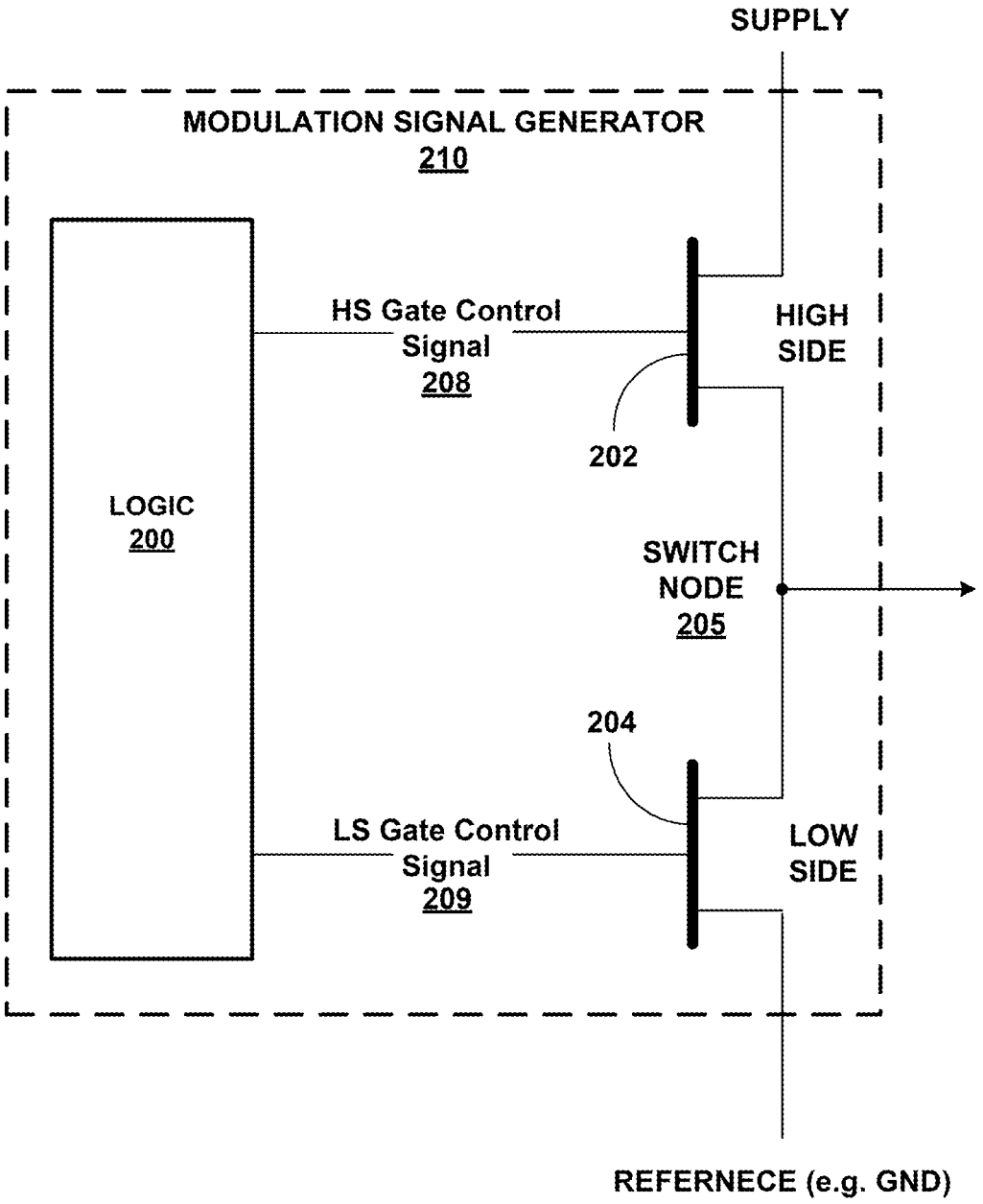
FIG. 2 is a circuit diagram showing some example details of a modulation signal generator within a driver circuit.

FIG. 2 is a circuit diagram showing some example details of a modulation signal generator 210 within a driver circuit. In some examples, modulation signal generator 210 may correspond to modulation signal generator 110 of FIG. 1. Modulation signal generator 210 may comprise logic 200 that performs various determinations associated with control signals from a processor, e.g., as described in this disclosure.

Modulation signal generator 210 may comprise a high side switch 202 and a low side switch 204 (e.g., power transistors) that form a half bridge. A supply is connected to high side switch 202 and a reference voltage (e.g., ground) is connected to low side switch 204. High side switch 202 and low side switch 204 form a half bridge with a so-called switch node 205 between the switches 202, 204. Logic 200 is configured to deliver gate control signals, e.g., high side (HS) gate control signal 208 and low side (LS) gate control signal 209 to high side switch 202 and low side switch 204 respectively. HS gate control signal 208 and LS gate control signal 209 may cause ON/OFF switching of high side switch 202 and low side switch 204 in a complementary fashion based on control signals received from a processor. In other words, gate control signals 208, 209 may be used to define ON-OFF switching of high side switch 202 and low side switch 204 in order to deliver the desired power to switch node 205 positioned between the high side and low side switches 202, 204. The complementary ON/OFF switching of high side and low side switches 202, 204 breaks power delivery into discrete modulation pulses at switch node 205, and the width of such pulses can be controlled to define the correct or desired amount of power delivered to an LED load. Moreover, as noted, the phase of such pulses may be defined to achieve desired lighting control of LEDs. FIG. 2 is an example for purposes of illustration, but in other examples, modulation signal generator 210 may include additional circuit elements.

Figure 3:
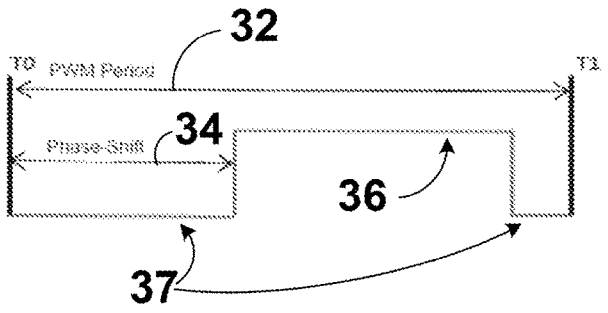
FIG. 3 is a graph illustrating a pulse width modulation (PWM) period and a phase shift.

FIG. 3 is a graph illustrating an example PWM period 32 and a phase shift 34. A PWM pulse is one example of a PM drive signal according to this disclosure. Given a PWM period 32, a PWM pulse may be defined by a phase-shift 34 and by a duty-cycle, wherein the duty cycle is the amount of ON time (e.g., a high signal 36 in the PWM pulse) relative to the OFF time (e.g., low signal 37 in the PWM pulse).

Figure 4:
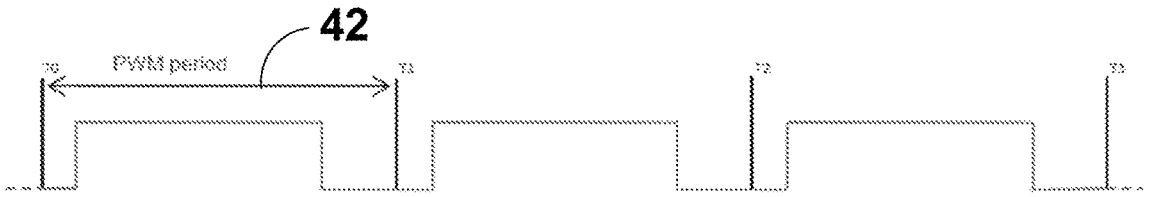
FIG. 4 is another graph showing a PMW period in a succession of PWM periods.

Phase-shift 34 may be defined as the delay of the pulse start with respect the beginning of the PWM period 32, and duty-cycle may be defined as the rate of PWM high pulse 36 relative to the PWM period 32. FIG. 4 shows an example of successive PWM pulses that repeat over PWM period 42 and successive periods, e.g., with nothing changing.

Figure 5:
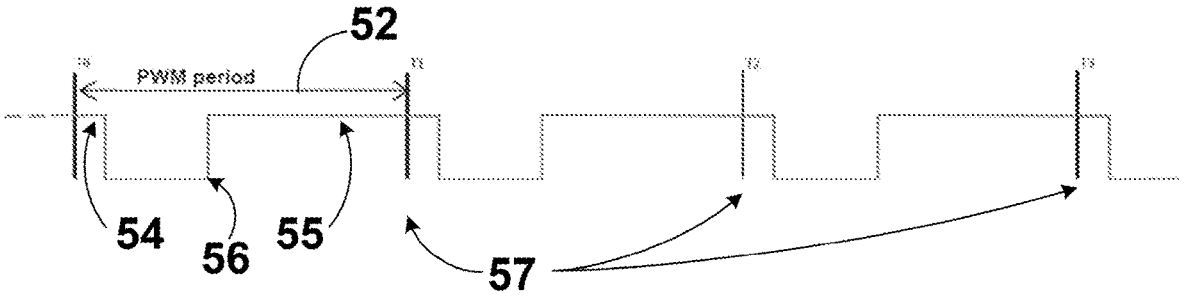
FIG. 5 is graph showing a PMW period in a succession of PWM periods with so-called wrapping.

In some example LED control schemes, PWM pulses are allowed to wrap over the boundary of two successive PWM period. FIG. 5 is a graph of example PWM pulses that are allowed to wrap over the boundary of PWM periods. In the example of FIG. 5, each PWM pulse within each PWM period 52 has a first high portion 54 and a second high portion 55 separated by a low portion 56. Thus, so-called wrapping of successive high pulses occurs at each PWM period boundary 57. Wrapping is desirable for some LED control, but it can sometimes lead to problems or glitches in LED output, e.g., if phase changes occur.

Figure 6A:
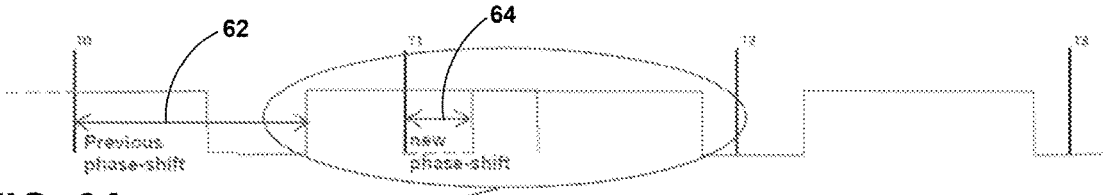
FIGS. 6A and 6B are two graphs showing a phase shift change that can cause a so-called long glitch, which may be undesirable.
Figure 6B:
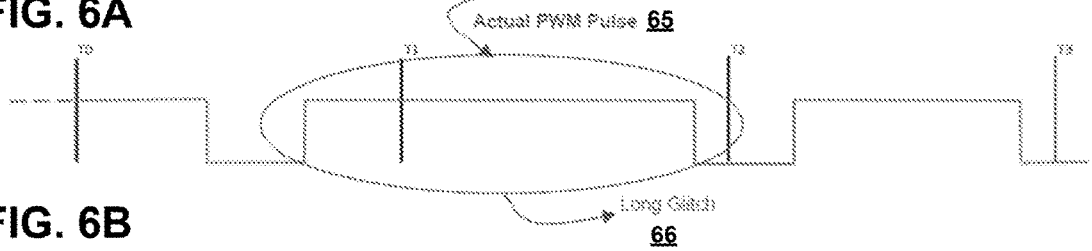

FIGS. 6A and 6B are two graphs showing a phase shift change that can cause a so-called long glitch, which may be undesirable. As shown in FIG. 6A, a previous phase shift 62 may be different than a new phase shift 64. In this case, the actual PWM pulse 65 shown in FIG. 6B can cause a long glitch 66 due to the LED control signal not being able to turn off to represent the new phase shift 64 because the previously-wrapped PWM pulse remains high. In this case, the new phase shift does not manifest in the LED output until the subsequent period, which can result in a long glitch 66 in the current PWM period associated with the phase change shift.

In order to reduce or eliminate a long glitch 66, a driver circuit may be configured to identify a phase shift change, and in response to identifying a phase shift change, the driver may be configured to terminate a PWM pulse in the new period associated with the phase shift change in order to provide a window of time for implementing the new phase shift in the current PWM period.

Figure 7A:
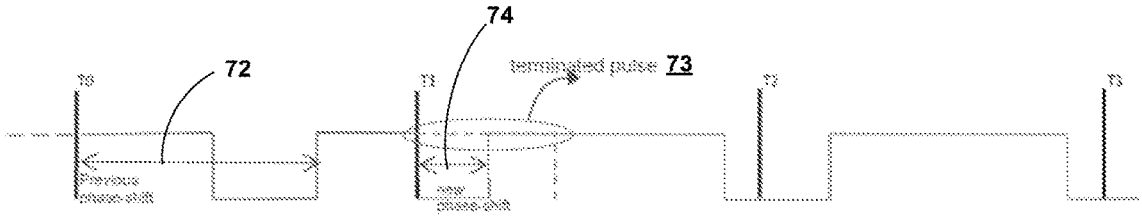
FIGS. 7A and 7B are two graphs showing an alternative response to a phase shift change that can cause a so-called short glitch, which may be more desirable than a long glitch.
Figure 7B:
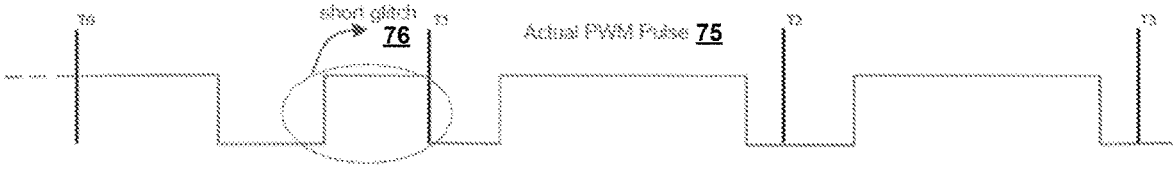

FIGS. 7A and 7B are two graphs showing an alternative response to a phase shift change that can eliminate a long glitch but may cause a so-called short glitch, which may be more desirable than a long glitch. FIG. 7A is similar to FIG. 6A. As shown in FIG. 7A, a previous phase shift 72 may be different than a new phase shift 74. However, by configuring a driver circuit to identify this change in phase shift, the currently wrapped PWM pulse can be terminated as shown by terminated pulse 73 at the beginning of the current PWM period associated with the phase shift change. In this case, the actual PWM pulse 75 shown in FIG. 7B can accurately reflect the phase shift change more quickly than the example shown in FIGS. 6A and 6B and without a long glitch. In this case, however, a short glitch 76 may be created in the previous period, i.e., that just prior to a current period associated with the phase change shift and the new actual PWM pulse 75.

Thus, the example shown in FIGS. 7A and 7B can improve LED control relative to the example shown in FIGS. 6A and 6B. In this case, a driver circuit 102 may be configured to determine whether control signals from processor 100 indicate a phase shift change; and in response to determining that the control signals indicate a phase shift change, driver circuit 102 may terminate a current PM signal at a beginning of a PM period (e.g., as shown by terminated pulse 73), and generate a new PM signal in the PM period (e.g., as shown by actual PWM pulse 75), wherein the new PM signal includes the phase shift change (i.e., the new phase shift 74).

Changing of phase-shift and duty-cycle is sometime used to change the intensity of LED light, and for RGB LEDs to change the emitted color of the light. The problem is that, in presence of pulse wrapping (e.g., as shown in FIG. 4), changing the phase-shift may cause a long glitch in the pulse itself (e.g., as shown in FIG. 5) and this may result in unacceptable lighting artifacts by the LEDs, especially, for RGB LEDs. Accordingly, due to long glitch generation, phase-shift changes are sometimes disallowed on the fly in LED drivers, in which case, it may be necessary to switch off LED lighting altogether for at least one full PWM cycle, change the phase-shift, and then to switch the LED lighting on again.

As set forth above, the techniques of this disclosure can solve the problem of the long glitch and introduce the opportunity of a phase-shift changes on the fly, without switching off the LED lighting altogether for at least one full PWM cycle. A "sample and decision point" can be introduced at the end of each PWM period (e.g., at times T0, T1, T2, and T3 of FIGS. 6A, 6B, 7A, 7B, and 8). If the previous pulse was a wrapped pulse, and a new phase-shift is required, the LED drive may terminate the previous pulse after the end of previous PWM period, and the new pulse, with the new phase shift, can be introduced inside the new PWM period. As noted, this solution may introduce a short glitch 76 shown in FIG. 7B, in the phase-shift transition, which is often acceptable, especially in RGB LED driving applications. Short glitch 76 shown in FIG. 7B, for example, may be a desirable improvement over long glitch 66 shown in FIG. 6B. In some cases, as part of the determinations, a driver circuit may also be configured to identify whether wrapping is occurring, but in some cases, wrapping may be assumed as part of the control scheme, in which case a separate wrapping determination may be unneeded by a driver circuit that executes the techniques of this disclosure.

Figure 8:
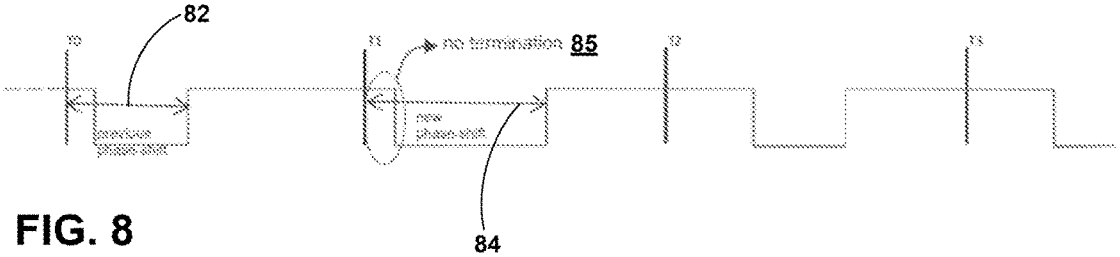
FIG. 8 is a graph showing a situation where the short glitch may be avoided.

In some situations, even a short glitch may be undesirable or unacceptable. To reduce or eliminate a short glitch, a driver circuit may implement also an enhancement to the solution explained above. For example, if the previous pulse was a wrapped pulse, and there is a new phase-shift request, at the "sample and decision point" (e.g., at the end of a period), the driver circuit may be configured to compare the new phase shift with previous phase shift, and terminate the current PWM pulse only if new phase-shift is less than or equal to the previous PWM pulse. Otherwise, the driver may elect not to terminate the current pulse so that no terminating is implemented, such as set forth in the following pseudo-code, which may be implemented in a driver circuit, e.g., in logic 200 of modulation signal generator of a driver circuit.

if previous_phase_shift+Δphase shift≤new_phase_shift==>no termination is implemented else==>previous pulse is terminated at the end of PWM period FIG. 8 is a graph showing an example situation where the short glitch may be avoided. In this case, a driver circuit may determine that a new phase shift 84 is greater than a previous phase shift 82 so that no termination (e.g., shown by element 85) is needed to eliminate a long glitch. In this case, both a short glitch and a long glitch are avoided.

Consistent with the example shown in FIG. 8, an LED driver circuit 102 shown in FIG. 1 may include an interface 108 configured to receive control signals 105 from a processor 100, and a signal generator 110 may be configured to generate PM drive signals 125 based on the control signals 105, wherein the PM drive signals 125 define phase shifts. In this case, signal generator 108 may be configured to determine whether the control signals 105 indicate a phase shift change; in response to determining that the control signals 105 indicate the phase shift change, determine whether a new phase shift is sufficiently less than a previous phase shift; in response to determining that the new phase shift is sufficiently less than the previous phase shift, terminate a current PM signal at a beginning of a PM period; and in response to determining that the control signals indicate the phase shift change, generate a new PM signal in the PM period, wherein the new PM signal includes the phase shift change. Moreover, signal generator 108 may be further configured to: in response to determining that the new phase shift is not sufficiently less than the current phase shift, generate the new PM signal in the PM period without terminating the current PM signal. With this technique, a long glitch is avoided in all situations and a short glitch is also avoided, as long a as a new phase shift 84 is sufficiently greater than a previous phase shift. With this technique, a short glitch may occur only in the situation where a new phase shift is less than the previous phase shift.

Consistent with this disclosure, in some examples, the control signals 105 indicate duty cycles and the phase shifts, and wherein at least some of the PM drive signals 125 wrap across successive PM periods associated with the PM signals. Moreover, the one or more LEDs 104, in some examples, comprise one or more Red, Green, or Blue LEDs. For example, LEDs 104 may comprise Red, Green, and Blue LEDs, and the driver circuit may control each of the Red, Green, and Blue LEDs, wherein the duty cycles and the phase shifts control a combined color created by a combination of the Red, Green, and Blue LEDs.

As with a basic solution illustrated in FIGS. 7A and 7B, with an enhanced solution that includes the additional steps, such as shown in FIG. 8 and set forth in the pseudo-code above, the determinations can be made during a sampling period that occurs between each of a plurality of PM periods associated with the PM signals. In any case, a signal generator 108 of a driver circuit 102 may be configured to: in response to determining that the control signals do not indicate a phase shift change, generate a new version of the current PM signal in the PM period without terminating the current PM signal at the beginning of the PM period. In other words, consistent with this disclosure, if phase shifts changes are not being made (or if no duty cycle or phase shift changes are signaled from processor 100), then the PM signals may continue without interruption or changes.

Figure 9:
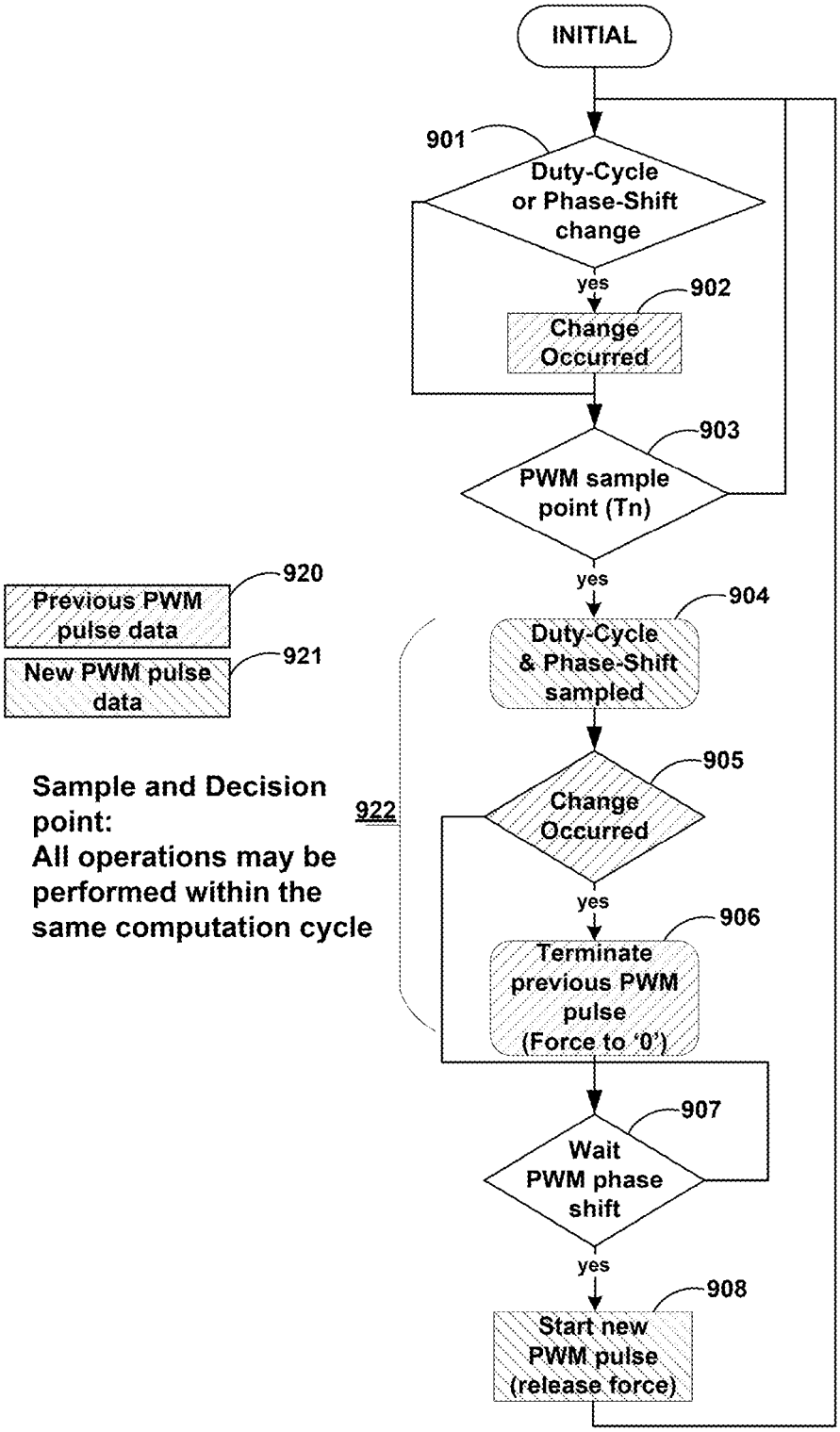
FIG. 9 is an example flow diagram to show one or more aspects of this disclosure.

FIG. 9 is an example flow diagram to show one or more aspects of this disclosure that may be performed by an LED driver circuit. In FIG. 9, cross-hashing is used to distinguish information associated with a previous PWM pulse data (920) from information associated new PWM pulse data (921). As shown in FIG. 9, an LED driver circuit, such as driver circuit 102 shown in FIG. 1 may identify a duty cycle or phase shift change (901), and in response to a change occurring (902), driver circuit 102 may check PWM pulse data at a sample point Tn (903). Sample point (Tn) may correspond to a sampling period that occurs between PWM periods. The steps of identifying that a change occurred (901 and 902), for example, may be performed by modulation signal generator 110, e.g., by comparing the duty cycle and phase shift of previous PWM pulse data to that of a new PWM pulse data. The new PWM pulse data, for example, may be communicated to processor interface 108 of driver circuit 102 by processor 100.

In some examples, the steps shown within sample and decision point (922) may correspond to steps performed by driver circuit 102 during a sample and decision period that occurs between successive PWM periods for each of a plurality of PWM periods. In particular, driver circuit 102 samples the duty cycle and phase shift of a new PWM pulse (904). If a change in phase shift occurred (905), modulation signal generator 108 may terminate the previous PWM pulse (906), i.e., force the pulse to zero, before completing that PWM pulse. In particular, modulation signal generator 108 may terminate a wrapped portion of the previous PWM pulse that would have otherwise wrapped into the next PWM period. Modulation signal generator 108 may then wait a short period of time corresponding to the new PWM phase shift (907), and after waiting for the new PWM phase shift (yes branch of 907), modulation signal generator 108 may start the new PWM pulse, and e.g., release its force to zero. In some cases, the example shown in FIG. 9 may result in PWM pulse generation that is similar to that illustrated in FIGS. 7A and 7B and described above. Thus, a long glitch may be avoided and a short glitch may occur.

Figure 10:
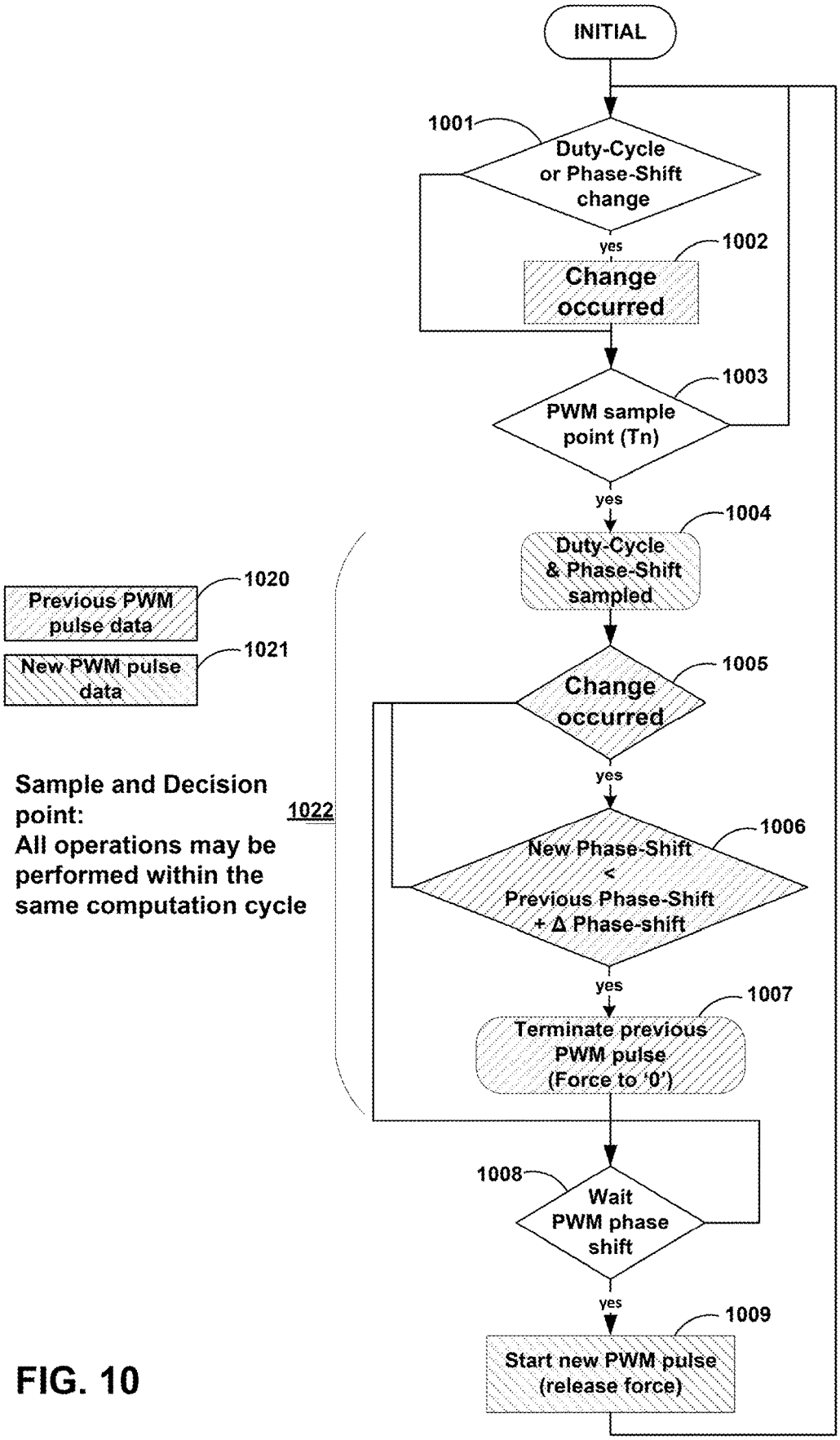
FIG. 10 is another example flow diagram to show one or more aspects of this disclosure.

FIG. 10 is another example flow diagram to show one or more aspects of this disclosure, which can avoid a long glitch for all situations and also eliminate a short glitch for some situations. In some cases, the example shown in FIG. 10 may result in PWM pulse generation that is similar to that illustrated in FIG. 8 and described above.

In FIG. 10, cross-hashing is again used to distinguish information associated with a previous PWM pulse data (1020) from information associated new PWM pulse data (1021). The previous PWM pulse data is also referred to herein as the current PWM pulse data insofar as the previous pulse data is that being currently used to drive the LEDs until the new PWM pulse data is applied.

As shown in FIG. 10, an LED driver circuit, such as driver circuit 102 shown in FIG. 1 may identify a duty cycle or phase shift change (1001), and in response to a change occurring (1002), driver circuit 102 may check PWM pulse data at a sample point Tn (1003). Again, sample point Tn may correspond to a sampling period that occurs between PWM periods. The steps of identifying that a change occurred (1001 and 1002), for example, may be performed by modulation signal generator 110, e.g., by comparing the duty cycle and phase shift of previous PWM pulse data to that of a new PWM pulse data. The new PWM pulse data, for example, may be communicated to processor interface 108 of driver circuit 102 by processor 100.

In some examples, the steps shown within sample and decision point (1022) may correspond to steps performed by driver circuit 102 during a sample and decision period that occurs between successive PWM periods for each of a plurality of PWM periods. In particular, in the example shown in FIG. 10, driver circuit 102 samples the duty cycle and phase shift of a new PWM pulse (1004). If a change in phase shift occurred (1005), modulation signal generator 108 may next determine whether the new phase shift is less than (or sufficiently less than a previous phase shift (1006). In other words, modulation signal generator 108 may next determine whether the new phase shift is less than the previous phase shift plus a delta phase shift, where the delta phase shift is a sufficient margin to ensure that the new phase shift can be signaled within the next PWM period. If a change in phase shift occurred (1005) and the new phase shift is sufficiently less than a previous phase shift (1006), modulation signal generator 108 may terminate the previous PWM pulse (1007), i.e., force the pulse to zero, before completing that PWM pulse. In particular, modulation signal generator 108 may terminate a wrapped portion of the previous PWM pulse that would have otherwise wrapped into the next PWM period. Modulation signal generator 108 may then wait a short period of time corresponding to the new PWM phase shift (1008), and after waiting for the new PWM phase shift (yes branch of 1008), modulation signal generator 108 may start the new PWM pulse, and e.g., release its force to zero.

In some examples, the entire determination process associated with possible early termination of a PWM pulse may be computed on PWM period basis. The information flow may be implemented in a driver circuit by three steps:

1) PWM sample point waiting.
2) Sample and decision point based on previous PWM pulse, and in case of enhanced solution there is also the comparation of the two phase-shifts.
3) PWM phase shift waiting for new PWM pulse.

A PWM sample point (Tn) is expected, when it occurs Duty-Cycle and Phase-Shift data are sampled, during this time if a change in these data occurs a flag «Change occurred» can be saved within the driver circuit.

After sampling data, a decision point may be computed by the driver circuit based on «change occurred» flag, if flag is '1' the previous PWM pulse is terminated, forcing it to '0' according to a "force to '0' state." If the "previous" pulse has no wrapping, force it to 0 doesn't produce any effect. In some examples, the steps set forth above, e.g., using the «change occurred» flag, can be viewed as implementing "Sample and Decision point" steps 922 or 1022 shown in FIGS. 9 and 10. After such determinations, the driver circuit waits for the PWM phase shift, and after that new PWM phase shift, a new PWM pulse can start, e.g., upon releasing the "force to '0' state."

Table 1 below is an example decision table based on some possible values of duty-cycle and phase-shift of previous PWM pulse with respect of next PWM pulse.

TABLE 1

| Previous PWM pulse | New PWM pulse DC_0% | DC_100% (*updated value) | S < P (*updated value) | S > P (*updated value) |
|---|---|---|---|---|
| DC_0% | — | Rise at S* | Rise at S* | Rise at S* |
| DC_100% | Fall at Tn | — | Fall at Tn & Rise at S* | Fall at Tn & Rise at S* |
| S < P | — | Rise at S* | — | Rise at S* |
| S > P | Fall at Tn | Fall at Tn & Rise at S* | Fall at Tn & Rise at S* | Fall at Tn & Rise at S* |

(S = Phase-Shift, start pulse)
(P = Phase-Shift + Duty-Cycle, stop pulse)
(referred to PWM Period Tn)

In some examples, the techniques of this disclosure performed by an LED driver may define a "sample and decision point" at the end of each PWM period and terminate the previous pulse if the previous pulse would overlap with the new pulse in the next PWM period.

Figure 11:
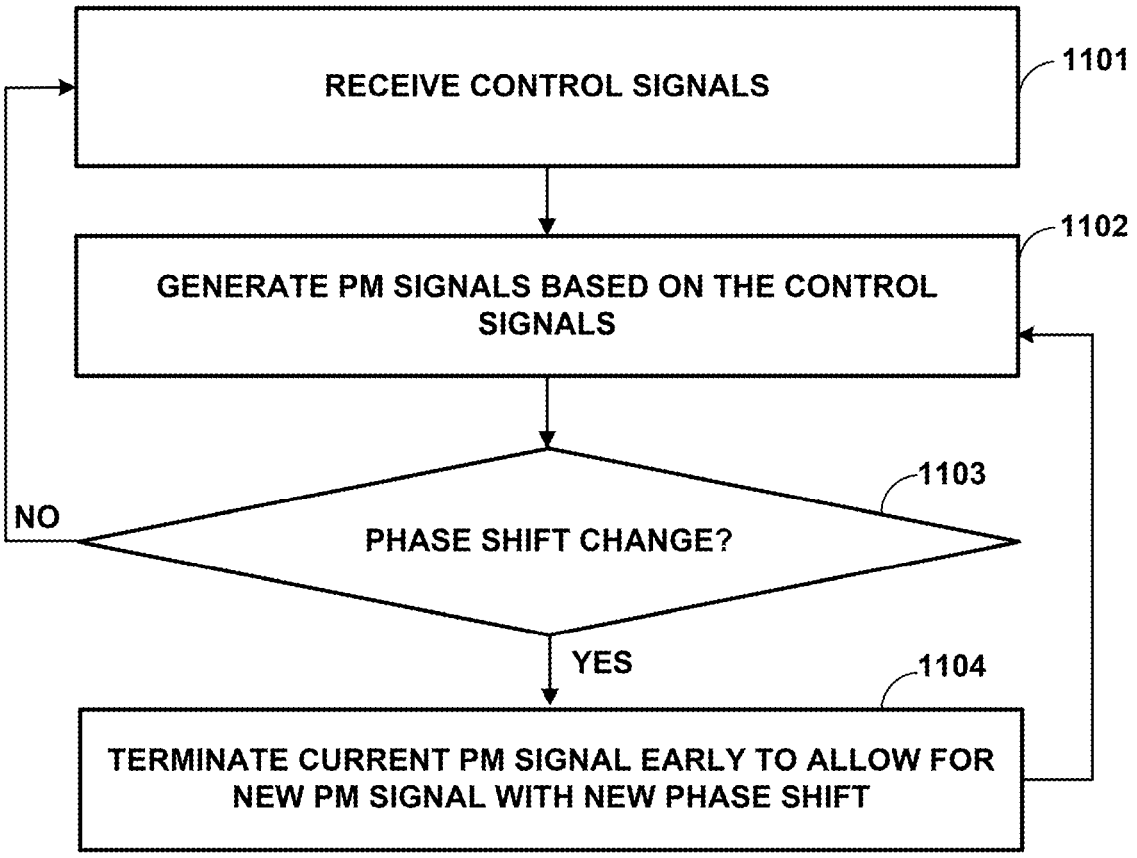
FIGS. 11 and 12 are flow diagrams showing two different example methods that may be performed by driver circuits consistent with this disclosure.
Figure 12:
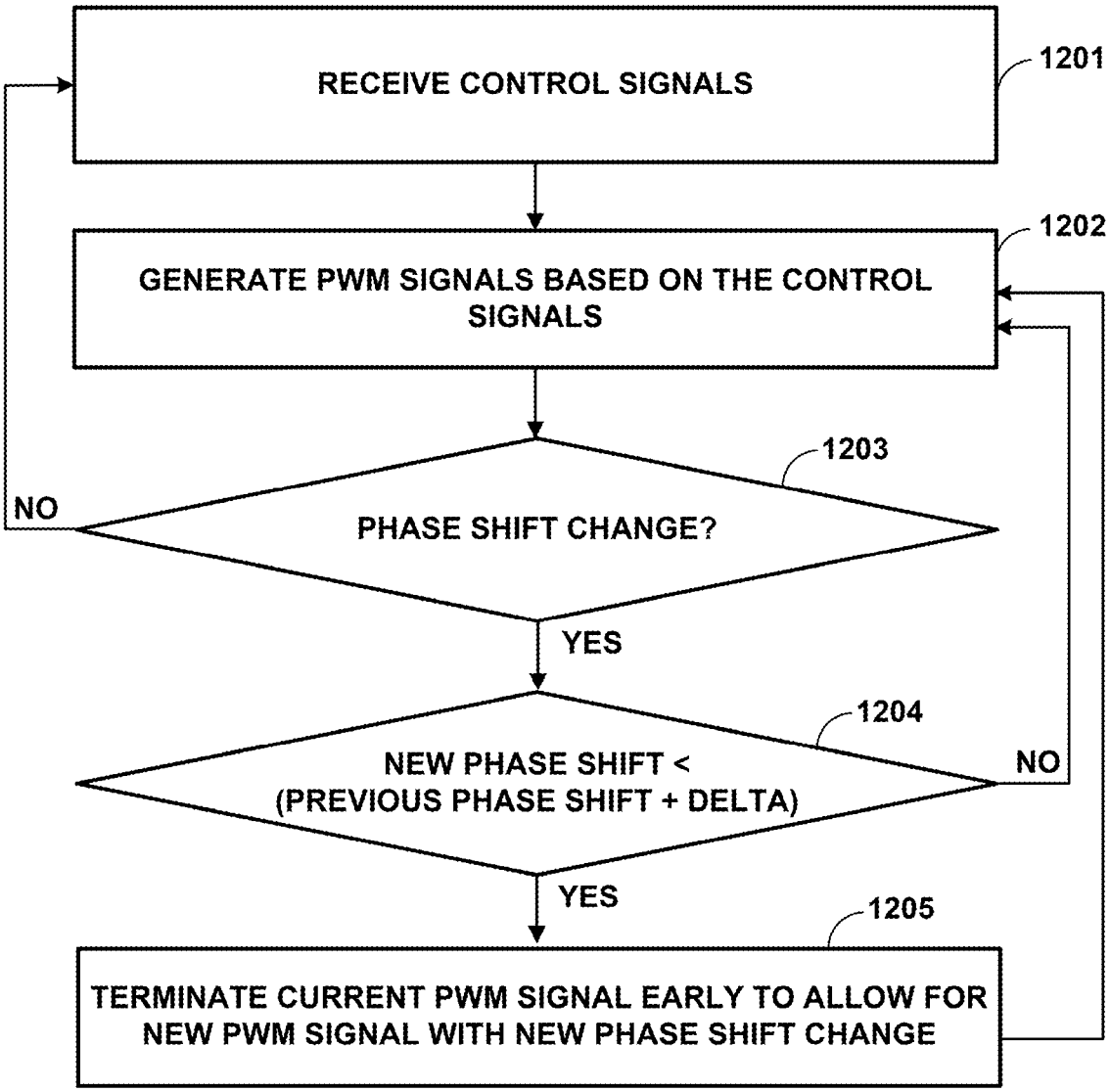

FIGS. 11 and 12 are flow diagrams showing two different example methods that may be performed by driver circuits consistent with this disclosure. FIGS. 11 and 12 will be described from the perspective of example LED driver circuit 102 shown in FIG. 1, although other driver circuits may also perform the techniques of FIGS. 11 and 12.

According to the example of FIG. 11, a driver circuit 102 receives control signals from a processor 100 (1101), e.g., via processor interface 108. The control signals, for example, may define phase shifts 120 and duty cycles 122. As shown in FIG. 11, driver circuit 102 generates PM signals based on the control signals (1102). For example, modulation signal generator 110 may be configured to generates the PM signals based on the control signals received from processor 100. The PM signals may define phase shifts, and in some cases, may define phase shifts and duty cycles.

During a sampling period that occurs between each of a plurality of PM periods associated with the PM signals, driver circuit 102 may be configured to determine whether the control signals indicate a phase shift change (1103). In response to determining that the control signals indicate a phase shift change, modulation signal generator 110 may be configured to terminate a current PM signal early in order to allow for a new PM signal with a new phase shift (1104). For example, modulation signal generator 110 may be configured to terminate a current PM signal at a beginning of a PM period, and then generate a new PM signal in the PM period, wherein the new PM signal includes the phase shift change. In response to determining that the control signals do not indicate a phase shift change, driver circuit 102 may not perform any early termination of PM signals, in which case, driver circuit 102 may continue outputting the current PM signal at the beginning of the new PM period. Moreover, in response to determining that the control signals do not indicate a phase shift change, driver circuit 102 may also generate a new version of the current PM signal in the PM period without terminating the current PM signal at the beginning of the PM period.

According to the example of FIG. 11, a driver circuit 102 receives control signals from a processor 100 (1201), e.g., via processor interface 108. Again, the control signals, for example, may define phase shifts 120 and duty cycles 122. As shown in FIG. 12, driver circuit 102 generates PM signals based on the control signals (1202). For example, modulation signal generator 110 may be configured to generates the PM signals based on the control signals received from processor 100. The PM signals may define phase shifts, and in some cases, may define phase shifts and duty cycles.

During a sampling period that occurs between each of a plurality of PM periods associated with the PM signals, driver circuit 102 may be configured to determine whether the control signals indicate a phase shift change (1203). In response to determining that the control signals indicate a phase shift change, modulation signal generator 110 may be further configured determine whether the new phase shift change is less than a previous phase shift change plus a delta (1204). Upon determining that the control signals indicate a phase shift change (yes branch of 1203) and that the new phase shift change is sufficiently less than the previous phase shift change (yes branch of 1204), driver circuit 102 ay be configured to terminate a current PM signal early in order to allow for a new PM signal with a new phase shift (1205).

Consistent with FIG. 12, driver circuit 102 may be configured to perform a method that includes receiving control signals from a processor (1201); generating PM signals based on the control signals (1202), wherein the PM signals define phase shifts; determining, during a sampling period that occurs between each of a plurality of PM periods associated with the PM signals, whether the control signals indicate a phase shift change (1203); in response to determining that the control signals indicate the phase shift change (yes branch of 1203), determining whether a new phase shift is sufficiently less than a previous phase shift (1204); in response to determining that the new phase shift is sufficiently less than the previous phase shift (yes branch of 1204), terminating a current PM signal at a beginning of a PM period (1205). In this case, driver circuit 102 may also, in response to determining that the control signals indicate the phase shift change 1203, generate a new PM signal in the PM period, wherein the new PM signal includes the phase shift change, and in response to determining that the control signals do not indicate a phase shift change, output the current PM signal at the beginning of the PM period.

Consistent with FIG. 12, in some examples, driver circuit 102 may in response to determining that the new phase shift is not sufficiently less than the current phase shift, generate the new PM signal in the PM period without terminating the current PM signal. Moreover, driver circuit 102 may, in response to determining that the control signals do not indicate a phase shift change, generate a new version of the current PM signal in the PM period without terminating the current PM signal at the beginning of the PM period.

In some examples, determining whether the control signals indicate a phase shift change (1103 or 1203) may occur during a sampling period between PWM periods. Moreover, in some examples, this determination can be made by reading one or more registers (e.g., volatile or non-volatile storage elements) in LED driver circuit. Referring again to FIGS. 9 and 10, for example, previous PWM pulse data 920, 1020 and new PWM pulse data 1020, 1021 can be stored in registers in driver circuit 102, e.g., registers associated with one or more pins of processor interface 108. One or more registers, for example, may be connected to processor interface 108 to store data associated with LED control signals 105. Readout of such registers during the sampling period, as set forth herein, is one example in which LED driver circuit 102 can be configured to determine whether the control signals indicate a phase shift change.

The following clauses may illustrate one or more aspects of the disclosure.

Clause 1—A driver circuit for driving one or more LEDs, wherein the driver circuit comprises: an interface configured to receive control signals from a processor; and a signal generator configured to generate PM signals based on the control signals, wherein the PM signals define phase shifts, and wherein the signal generator is configured to: determine whether the control signals indicate a phase shift change; and in response to determining that the control signals indicate a phase shift change, terminate a current PM signal at a beginning of a PM period, and generate a new PM signal in the PM period, wherein the new PM signal includes the phase shift change.

Clause 2—The driver circuit of clause 1, wherein the control signals indicate duty cycles and the phase shifts, and wherein at least some of the PM signals wrap across successive PM periods associated with the PM signals.

Clause 3—The driver circuit of clause 1 or 2, wherein the control signals indicate duty cycles and the phase shifts, and wherein one or more LEDs comprise one or more Red, Green, or Blue LEDs.

Clause 4—The driver circuit of clause 3, wherein the one or more LEDs comprise Red, Green, and Blue LEDs, wherein the driver circuit controls each of the Red, Green, and Blue LEDs, and wherein the duty cycles and the phase shifts control a combined color created by a combination of the Red, Green, and Blue LEDs.

Clause 5—The driver circuit of any of clauses 1-4, wherein the signal generator is configured to: determine, during a sampling period that occurs between each of a plurality of PM periods associated with the PM signals, whether the control signals indicate the phase shift change.

Clause 6—The driver circuit of any of clauses 1-5, wherein the signal generator is configured to: in response to determining that the control signals do not indicate a phase shift change, generate a new version of the current PM signal in the PM period without terminating the current PM signal at the beginning of the PM period.

Clause 7—A driver circuit for driving one or more LEDs, wherein the driver circuit comprises: an interface configured to receive control signals from a processor; and a signal generator configured to generate pulse modulation (PM) signals based on the control signals, wherein the PM signals define phase shifts, and wherein the signal generator is configured to: determine whether the control signals indicate a phase shift change; in response to determining that the control signals indicate the phase shift change, determine whether a new phase shift is sufficiently less than a previous phase shift; in response to determining that the new phase shift is sufficiently less than the previous phase shift, terminate a current PM signal at a beginning of a PM period; and in response to determining that the control signals indicate the phase shift change, generate a new PM signal in the PM period, wherein the new PM signal includes the phase shift change.

Clause 8—The driver circuit of clause 7, wherein the signal generator is further configured to: in response to determining that the new phase shift is not sufficiently less than the current phase shift, generate the new PM signal in the PM period without terminating the current PM signal.

Clause 9— The driver circuit of clause 7 or 8, wherein the control signals indicate duty cycles and the phase shifts, and wherein at least some of the PM signals wrap across successive PM periods associated with the PM signals.

Clause 10— The driver circuit of any of clauses 7-9, wherein the control signals indicate duty cycles and the phase shifts, and wherein one or more LEDs comprise one or more Red, Green, or Blue LEDs.

Clause 11— The driver circuit of clause 11, wherein the one or more LEDs comprise Red, Green, and Blue LEDs, wherein the driver circuit controls each of the Red, Green, and Blue LEDs, and wherein the duty cycles and the phase shifts control a combined color created by a combination of the Red, Green, and Blue LEDs.

Clause 12— The driver circuit of any of clauses 7-11, wherein the signal generator is configured to: determine, during a sampling period that occurs between each of a plurality of PM periods associated with the PM signals, whether the control signals indicate the phase shift change.

Clause 13— The driver circuit of clause 7, wherein the signal generator is configured to: in response to determining that the control signals do not indicate a phase shift change, generate a new version of the current PM signal in the PM period without terminating the current PM signal at the beginning of the PM period.

Clause 14— A method of driving one or more LEDs, the method comprising: receiving control signals from a processor; generating PM signals based on the control signals, wherein the PM signals define phase shifts; determining, during a sampling period that occurs between each of a plurality of PM periods associated with the PM signals, whether the control signals indicate a phase shift change; in response to determining that the control signals indicate a phase shift change, terminating a current PM signal at a beginning of a PM period, and generating a new PM signal in the PM period, wherein the new PM signal includes the phase shift change; and in response to determining that the control signals do not indicate a phase shift change, outputting the current PM signal at the beginning of the PM period.

Clause 15— The method of clause 14, further comprising: in response to determining that the control signals do not indicate a phase shift change, generating a new version of the current PM signal in the PM period without terminating the current PM signal at the beginning of the PM period.

Clause 16— A method of driving one or more LEDs, the method comprising: receiving control signals from a processor; generating PM signals based on the control signals, wherein the PM signals define phase shifts; determining, during a sampling period that occurs between each of a plurality of PM periods associated with the PM signals, whether the control signals indicate a phase shift change; in response to determining that the control signals indicate the phase shift change, determining whether a new phase shift is sufficiently less than a previous phase shift; in response to determining that the new phase shift is sufficiently less than the previous phase shift, terminating a current PM signal at a beginning of a PM period; in response to determining that the control signals indicate the phase shift change, generating a new PM signal in the PM period, wherein the new PM signal includes the phase shift change; and in response to determining that the control signals do not indicate a phase shift change, outputting the current PM signal at the beginning of the PM period.

Clause 17— The method of clause 16, further comprising: in response to determining that the new phase shift is not sufficiently less than the current phase shift, generating the new PM signal in the PM period without terminating the current PM signal.

Clause 18— The method of clause 16 or 17, further comprising: in response to determining that the control signals do not indicate a phase shift change, generating a new version of the current PM signal in the PM period without terminating the current PM signal at the beginning of the PM period.

Clause 19— A system comprising: a processor; one or more light emitting diodes LEDs; and a driver circuit for driving the one or more LEDs based on control signals from the processor, wherein the driver circuit comprises: an interface configured to receive the control signals from the processor; and a signal generator configured to generate PM signals based on the control signals, wherein the PM signals define phase shifts, and wherein the signal generator is configured to: determine whether the control signals indicate a phase shift change; and in response to determining that the control signals indicate a phase shift change, terminate a current PM signal at a beginning of a PM period, and generate a new PM signal in the PM period, wherein the new PM signal includes the phase shift change.

Clause 20— A system comprising: a processor; one or more LEDs; and a driver circuit for driving the one or more LEDs based on control signals from the processor, wherein the driver circuit comprises: an interface configured to receive the control signals from the processor; and a signal generator configured to generate pulse modulation (PM) signals based on the control signals, wherein the PM signals define phase shifts, and wherein the signal generator is configured to: determine whether the control signals indicate a phase shift change; in response to determining that the control signals indicate the phase shift change, determine whether a new phase shift is sufficiently less than a previous phase shift; in response to determining that the new phase shift is sufficiently less than the previous phase shift, terminate a current PM signal at a beginning of a PM period; and in response to determining that the control signals indicate the phase shift change, generate a new PM signal in the PM period, wherein the new PM signal includes the phase shift change.

Various aspects have been described in this disclosure. These and other aspects are within the scope of the following claims.

The invention claimed is:

1. A driver circuit for driving one or more light emitting diodes (LEDs), wherein the driver circuit comprises:

a processor interface configured to receive control signals from an external processor; and a modulation signal generator configured to generate pulse modulation (PM) signals based on the control signals, wherein the PM signals define phase shifts, and wherein the modulation signal generator is configured to:

determine whether the control signals indicate a phase shift change; and in response to determining that the control signals indicate a phase shift change, terminate a current PM signal at a beginning of a PM period, and generate a new PM signal in the PM period, wherein the new PM signal includes the phase shift change.

2. The driver circuit of claim 1, wherein the control signals indicate duty cycles and the phase shifts, and wherein at least some of the PM signals wrap across successive PM periods associated with the PM signals.

3. The driver circuit of claim 1, wherein the control signals indicate duty cycles and the phase shifts, and wherein one or more LEDs comprise one or more Red, Green, or Blue LEDs.

4. The driver circuit of claim 3, wherein the one or more LEDs comprise Red, Green, and Blue LEDs, wherein the driver circuit controls each of the Red, Green, and Blue LEDs, and wherein the duty cycles and the phase shifts control a combined color created by a combination of the Red, Green, and Blue LEDs.

5. The driver circuit of claim 1, wherein the modulation signal generator is configured to:

determine, during a sampling period that occurs between each of a plurality of PM periods associated with the PM signals, whether the control signals indicate the phase shift change.

6. The driver circuit of claim 1, wherein the modulation signal generator is configured to:

in response to determining that the control signals do not indicate a phase shift change, generate a new version of the current PM signal in the PM period without terminating the current PM signal at the beginning of the PM period.

7. A driver circuit for driving one or more light emitting diodes (LEDs), wherein the driver circuit comprises:

a processor interface configured to receive control signals from an external processor; and a modulation signal generator configured to generate pulse modulation (PM) signals based on the control signals, wherein the PM signals define phase shifts, and wherein the modulation signal generator is configured to:

determine whether the control signals indicate a phase shift change;

in response to determining that the control signals indicate the phase shift change, determine whether a new phase shift is sufficiently less than a previous phase shift;

in response to determining that the new phase shift is sufficiently less than the previous phase shift, terminate a current PM signal at a beginning of a PM period; and in response to determining that the control signals indicate the phase shift change, generate a new PM signal in the PM period, wherein the new PM signal includes the phase shift change.

8. The driver circuit of claim 7, wherein the modulation signal generator is further configured to:

in response to determining that the new phase shift is not sufficiently less than the current phase shift, generate the new PM signal in the PM period without terminating the current PM signal.

9. The driver circuit of claim 7, wherein the control signals indicate duty cycles and the phase shifts, and wherein at least some of the PM signals wrap across successive PM periods associated with the PM signals.

10. The driver circuit of claim 7, wherein the control signals indicate duty cycles and the phase shifts, and wherein one or more LEDs comprise one or more Red, Green, or Blue LEDs.

11. The driver circuit of claim 10, wherein the one or more LEDs comprise Red, Green, and Blue LEDs, wherein the driver circuit controls each of the Red, Green, and Blue LEDs, and wherein the duty cycles and the phase shifts control a combined color created by a combination of the Red, Green, and Blue LEDs.

12. The driver circuit of claim 7, wherein the modulation signal generator is configured to:

determine, during a sampling period that occurs between each of a plurality of PM periods associated with the PM signals, whether the control signals indicate the phase shift change.

13. The driver circuit of claim 7, wherein the modulation signal generator is configured to:

in response to determining that the control signals do not indicate a phase shift change, generate a new version of the current PM signal in the PM period without terminating the current PM signal at the beginning of the PM period.

14. A method of driving one or more light emitting diodes (LEDs), the method comprising:

receiving control signals via a processor interface from an external processor;

generating, via a modulation signal generator, pulse modulation (PM) signals based on the control signals, wherein the PM signals define phase shifts;

determining, via the modulation signal generator during a sampling period that occurs between each of a plurality of PM periods associated with the PM signals, whether the control signals indicate a phase shift change;

in response to determining that the control signals indicate a phase shift change, terminating, via the modulation signal generator, a current PM signal at a beginning of a PM period, and generating a new PM signal in the PM period, wherein the new PM signal includes the phase shift change; and in response to determining that the control signals do not indicate a phase shift change, outputting, via the modulation signal generator, the current PM signal at the beginning of the PM period.

15. The method of claim 14, further comprising:

in response to determining that the control signals do not indicate a phase shift change, generating, via the modulation signal generator, a new version of the current PM signal in the PM period without terminating the current PM signal at the beginning of the PM period.

16. A method of driving one or more light emitting diodes (LEDs), the method comprising:

receiving control signals via a processor interface from an external processor;

generating, via a modulation signal generator, pulse modulation (PM) signals based on the control signals, wherein the PM signals define phase shifts;

determining, via the modulation signal generator during a sampling period that occurs between each of a plurality of PM periods associated with the PM signals, whether the control signals indicate a phase shift change;

in response to determining that the control signals indicate the phase shift change, determining, via the modulation signal generator, whether a new phase shift is sufficiently less than a previous phase shift;

in response to determining that the new phase shift is sufficiently less than the previous phase shift, terminating, via the modulation signal generator, a current PM signal at a beginning of a PM period;

in response to determining that the control signals indicate the phase shift change, generating, via the modulation signal generator, a new PM signal in the PM period, wherein the new PM signal includes the phase shift change; and in response to determining that the control signals do not indicate a phase shift change, outputting, via the modulation signal generator, the current PM signal at the beginning of the PM period.

17. The method of claim 16, further comprising:

in response to determining that the new phase shift is not sufficiently less than the current phase shift, generating, via the modulation signal generator, the new PM signal in the PM period without terminating the current PM signal.

18. The method of claim 16, further comprising:

in response to determining that the control signals do not indicate a phase shift change, generating, via the modulation signal generator, a new version of the current PM signal in the PM period without terminating the current PM signal at the beginning of the PM period.

* * * * *